US009016418B2

(12) United States Patent
Ootsuka et al.

(10) Patent No.: US 9,016,418 B2
(45) Date of Patent: Apr. 28, 2015

(54) CONSTRUCTION MACHINE

(71) Applicant: Hitachi Construction Machinery Co., Ltd., Tokyo (JP)

(72) Inventors: Kakurou Ootsuka, Tsuchiura (JP); Hidefumi Hiramatsu, Hitachinaka (JP); Tsuyoshi Ueki, Omitama (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 14/342,835

(22) PCT Filed: Nov. 6, 2012

(86) PCT No.: PCT/JP2012/078703
§ 371 (c)(1),
(2) Date: Mar. 5, 2014

(87) PCT Pub. No.: WO2013/069628
PCT Pub. Date: May 16, 2013

(65) Prior Publication Data

US 2014/0186151 A1 Jul. 3, 2014

(30) Foreign Application Priority Data

Nov. 11, 2011 (JP) ..... 2011-247478

(51) Int. Cl.
*B62D 23/00* (2006.01)
*E02F 9/22* (2006.01)
*E02F 9/08* (2006.01)

(52) U.S. Cl.
CPC ..... *E02F 9/2267* (2013.01); *E02F 9/0833* (2013.01); *E02F 9/0875* (2013.01); *E02F 9/0883* (2013.01); *E02F 9/2282* (2013.01); *E02F 9/2285* (2013.01); *E02F 9/2292* (2013.01); *E02F 9/2296* (2013.01); *E02F 9/08* (2013.01); *E02F 9/0808* (2013.01); *E02F 9/0891* (2013.01)

(58) Field of Classification Search
USPC ..... 180/89.1, 89.12, 324, 331; 172/82; 701/50
See application file for complete search history.

(56) References Cited

U.S. PATENT DOCUMENTS 5,678,469 A * 10/1997 Lech ..... 91/516
5,937,645 A * 8/1999 Hamamoto ..... 60/422
6,082,106 A * 7/2000 Hamamoto ..... 60/422
(Continued)

FOREIGN PATENT DOCUMENTS

JP 2000-248582 A 9/2000
JP 2002-188175 A 7/2002
(Continued)

*Primary Examiner* — Toan To
(74) *Attorney, Agent, or Firm* — Mattingly & Malur, PC

(57) ABSTRACT

A right front housing cover is arranged in the right side of a working mechanism, and a first control valve is arranged in a front portion side of a valve accommodation room that is covered with the right front housing cover. Further, a signal control valve block is arranged in the back side of the first control valve and in the upper side of the first control valve, and a solenoid valve is arranged in the back side of the signal control valve block. A front surface plate forming part of the right front housing cover has a lower side is inclined in an oblique downward direction toward the forward side, and is arranged along a virtual line that extends in an oblique downward direction through a front end portion of the first control valve and a front end portion of the signal control valve block.

7 Claims, 7 Drawing Sheets

(56) References Cited

U.S. PATENT DOCUMENTS

| | | | | |
|---|---|---|---|---|
| 6,260,467 | B1 * | 7/2001 | Mickelson et al. | 91/31 |
| 2009/0308066 | A1 * | 12/2009 | Satake | 60/433 |
| 2013/0298545 | A1 * | 11/2013 | Berg | 60/471 |
| 2013/0325235 | A1 * | 12/2013 | Kurikuma et al. | 701/22 |

FOREIGN PATENT DOCUMENTS

| | | | |
|---|---|---|---|
| JP | 2010-106522 | A | 5/2010 |
| JP | 2011-163035 | A | 8/2011 |

* cited by examiner

CONSTRUCTION MACHINE

TECHNICAL FIELD

The present invention relates to a construction machine, such as a hydraulic excavator or a wheel type hydraulic excavator, and more particularly to a construction machine in which a control valve unit is arranged in a front portion right side in a vehicle body.

BACKGROUND ART

In general, a construction machine, such as a hydraulic excavator or a wheel type hydraulic excavator, has a vehicle body that is configured of an automotive lower traveling structure, and an upper revolving structure that is mounted on the lower traveling structure to be capable of revolving thereon. A working mechanism that performs an excavating operation or the like is tiltably provided in a front portion side of the upper revolving structure. The construction machine, after self-traveling to a working site, uses the working mechanism to perform an excavating operation of earth and sand or the like.

Here, the construction machine is provided with a hydraulic motor for traveling that drives a crawler or wheels, a hydraulic motor for revolving that revolves the upper revolving structure, and various kinds of hydraulic actuators such as hydraulic cylinders that drive a boom, an arm and a bucket that form part of the working mechanism and the like. Further, the construction machine is provided with a hydraulic pump that delivers pressurized oil toward the respective hydraulic actuators, and an operation device that is operated by an operator for driving the respective hydraulic actuators.

On the other hand, the construction machine is provided with a first control valve (control valve) that is configured of a collector of a plurality of directional control valves for controlling a direction of the pressurized oil to be supplied to respective hydraulic actuators from the hydraulic pump. Aside from the first control valve, a second control valve (shuttle block) and a third control valve (solenoid valve) are provided for controlling hydraulic equipment including the hydraulic actuator and the hydraulic pump or for outputting an operation signal that is output to the directional control valve of the first control valve from the operation device (for example, Patent Document 1).

PRIOR ART DOCUMENT

Patent Document

Patent Document 1: Japanese Patent Laid-Open No. 2000-248582 A

SUMMARY OF THE INVENTION

Incidentally, the construction machine according to the conventional art as described above is configured such that the first control valve, the second control valve and the third control valve are intensively arranged between an engine disposed in the front side of a counter weight and a foot portion of the boom forming part of the working mechanism.

However, in the wheel type hydraulic excavator in which wheels are provided in the lower traveling structure or in a backward-small revolving type hydraulic excavator, the counterweight is disposed to be close to a revolving center of the upper revolving structure for reducing a revolving radius of the upper revolving structure to be small. In consequence, in the wheel type hydraulic excavator or in the backward-small revolving type hydraulic excavator, an accommodating space of equipments that is disposed in the front side of the engine is narrow, and therefore it is difficult to arrange the first control valve, the second control valve, the third control valve, and the like in this narrow accommodation space.

Therefore, in the wheel type hydraulic excavator or in the backward-small revolving type hydraulic excavator, a right front housing cover within which a valve accommodation room is formed is disposed in a front portion right side in the vehicle body, and the first control valve, the second control valve, the third control valve, and the like are arranged in the right front housing cover. However, in the case where the first control valve, the second control valve, the third control valve, and the like are arranged to line up in the front-rear direction, a dimension of the right front housing cover in the front-rear direction becomes large. Therefore, when an operator in a cab looks visually in the right forward side, there is a problem that a range of view of the operator is largely blocked by the right front housing cover.

In view of the above described conventional art problems, it is an object of the present invention to provide a construction machine that can improve a range of an operator's view when an operator looks visually ahead of a vehicle body on the right.

(1) A construction machine according to the present invention comprises an automotive vehicle body; a working mechanism that is tiltably provided in a front portion side of the vehicle body; a cab that is positioned in the left side of the working mechanism and is provided in a front portion side in the vehicle body to define an operator's room; a right front housing cover that is positioned in the right side of the working mechanism and is provided in a front portion side in the vehicle body and within which a valve accommodation room is formed; a hydraulic pump that is mounted on the vehicle body to deliver pressurized oil toward a plurality of hydraulic actuators; and an operation device that is provided in the cab to be operated by an operator for driving the respective hydraulic actuators, wherein a first control valve that is configured of a collector of a plurality of directional control valves to control a flowing direction of the pressurized oil to be supplied to the respective hydraulic actuators from the hydraulic pump, a second control valve that outputs an operation signal output to the directional control valves of the first control valve from the operation device, and a third control valve that controls hydraulic equipment including the hydraulic actuator and the hydraulic pump, are provided in the right front housing cover.

A characteristic of a configuration adopted by the present invention is that the first control valve is arranged in a front portion side in the valve accommodation room, the second control valve is arranged in the back side of the first control valve and in the upper side of the first control valve, the third control valve is arranged in the back side of the second control valve, and the right front housing cover is provided along a virtual line extending in an oblique downward direction through a front end of the first control valve and a front end of the second control valve.

With this arrangement, the second control valve is arranged in the back side of the first control valve and in the upper side of the first control valve, and thereby the first control valve and the second control valve can be arranged to line up in the upper-lower direction. Therefore, as compared to a case where the first control valve and the second control valve are arranged to line up in the front-rear direction, a dimension of the right front housing cover that covers the valve accommodation room in the front-rear direction can be reduced to move (retract) a position of the front end portion of the right front housing cover to the backward side. On the other hand, by providing the right front housing cover along the virtual line extending in the oblique downward direction through the front end of the first control valve and the front end of the second control valve, an upper end side in the right front housing cover is inclined in an oblique downward direction from backward to forward. As a result, when an operator in the cab visually looks ahead of the vehicle body on the right, a range of view of the operator in the right-front side can be improved without largely blocking the range of view of the operator by the front end side of the right front housing cover.

(2) According to the present invention, the right front housing cover comprises: a left side plate and a right side plate that cover the valve accommodation room from the left side and right side; and a front surface plate that covers the valve accommodation room from upward and forward, wherein the front surface plate is formed in a polygonal shape projecting as a whole, and is provided with a lower side inclined surface portion at a halfway section to be inclined in an oblique downward direction toward the forward side, and the lower side inclined surface portion is configured to be substantially in parallel with the virtual line.

With this arrangement, the upper end side of the right front housing cover can be inclined in the oblique downward direction from backward to forward, and the range of view of an operator can be improved when the operator in the cab looks ahead of the vehicle body on the right.

(3) According to the present invention, the second control valve is configured to be arranged in a stepwise manner in the upper side of the first control valve in a state of overlapping a rear portion side in the first control valve in the upper-lower direction.

With this arrangement, the second control valve overlaps the rear portion side in the first control valve, which allows a space in the right front housing cover in the front-rear direction occupied by the first control valve and the second control valve to be small. As a result, the dimension of the right front housing cover in the front-rear direction can be made small to move the position of the front end portion in the right front housing cover to the backward side, and therefore a range of view of an operator ahead of the cab on the right can be improved.

(4) According to the present invention, a vehicle body frame that is a base of the vehicle body comprises: a center frame including a bottom plate, and left and right vertical plates that are provided to rise on the bottom plate and extend in the front-rear direction; and a left side frame and a right side frame that are arranged in the left side and right side of the center frame, a boom foot portion of the working mechanism is rotatably mounted to the left and right vertical plates of the center frame through a boom foot pin, and the first control valve and the second control valve are arranged in the front side of an axis line of the boom foot pin.

With this arrangement, by arranging the first control valve and the second control valve in the front side of the axis line of the boom foot pin, the boom foot pin is inserted in and removed out from the left and right vertical plates of the center frame and the boom foot portion of the working mechanism in a state where the second control valve is mounted on the rear side in the first control valve.

(5) According to the present invention, a pin inserting/removing space is provided between a right side plate of the right front housing cover and the right vertical plate of the center frame to be positioned in the lower side of the third control valve for inserting/removing the boom foot pin in/from the left and right vertical plates.

With this arrangement, by providing the pin inserting/removing space downward of the third control valve, the boom foot pin is inserted in and removed out from the left and right vertical plates of the center frame and the boom foot portion of the working mechanism in a state where the third control valve is mounted on the rear side in the second control valve.

(6) According to the present invention, a bracket is provided in the first control valve to project from the rear portion side to the upward side, wherein the second control valve and the third control valve are removably mounted on the bracket.

With this arrangement, by providing the bracket on the first control valve and mounting the second control valve and the third control valve on the bracket, the second control valve and the third control valve can be simultaneously inserted in or removed from the first control valve by using the bracket to improve workability at the time of mounting the second control valve and the third control valve on the first control valve.

(7) According to the present invention, a fuel tank is positioned in the back side of the right front housing cover at the right side of the vehicle body to form a rear surface of the valve accommodation room, and the right front housing cover is provided with a step which is a foothold for getting on the vehicle body. With this arrangement, an operator can easily get on the vehicle body by using the step provided in the right front housing cover as the foothold.

BRIEF DESCRIPTION OF THE DRAWINGS

FIG. 7 is a hydraulic system diagram including hydraulic pumps, the first control valve unit, the signal control valve block, the solenoid valve and the like.

MODE FOR CARRYING OUT THE INVENTION

Hereinafter, an embodiment of a construction machine according to the present invention will be in detail explained with reference to FIG. 1 to FIG. 7 by taking a case of being applied to a wheel type hydraulic excavator as an example.

Designated at 1 is a wheel type hydraulic excavator as a construction machine. A vehicle body of the wheel type hydraulic excavator 1 is configured of a wheel type lower traveling structure 2 having right and left front wheels 2A and right and left rear wheels 2B, and an upper revolving structure 3 that is mounted on the lower traveling structure 2 to be capable of revolving thereon. A working mechanism 4 is tiltably provided in a front portion side of the upper revolving structure 3. The wheel type hydraulic excavator 1 travels on a public road by the lower traveling structure 2, and performs an excavating operation of earth and sand and the like by using the working mechanism 4 while revolving the upper revolving structure 3 at a working site.

Figure 3:
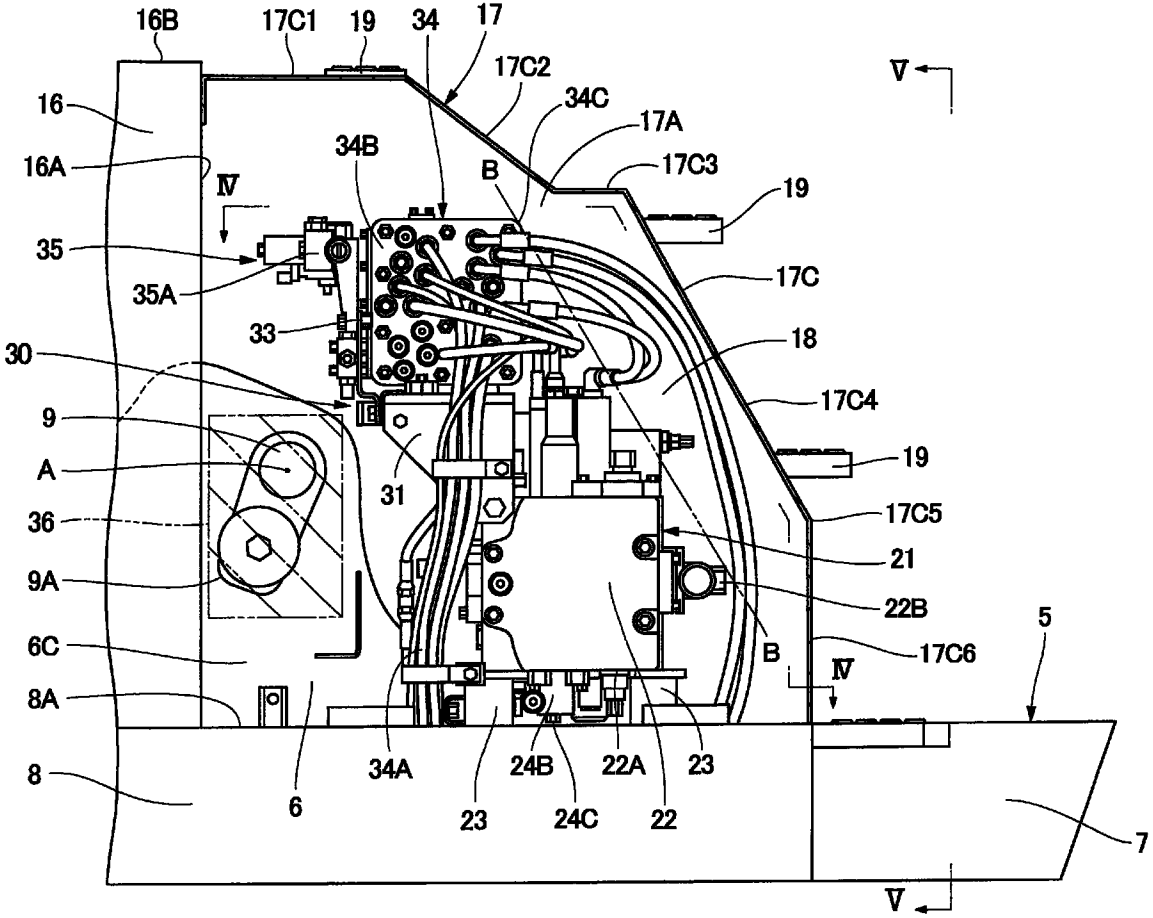
FIG. 3 is a front view showing a primary part of a right vertical plate, a boom foot pin, a right front housing cover, a first control valve unit, a signal control valve block, a solenoid valve and the like in FIG. 1 in a state where the primary part is enlarged.
Figure 4:
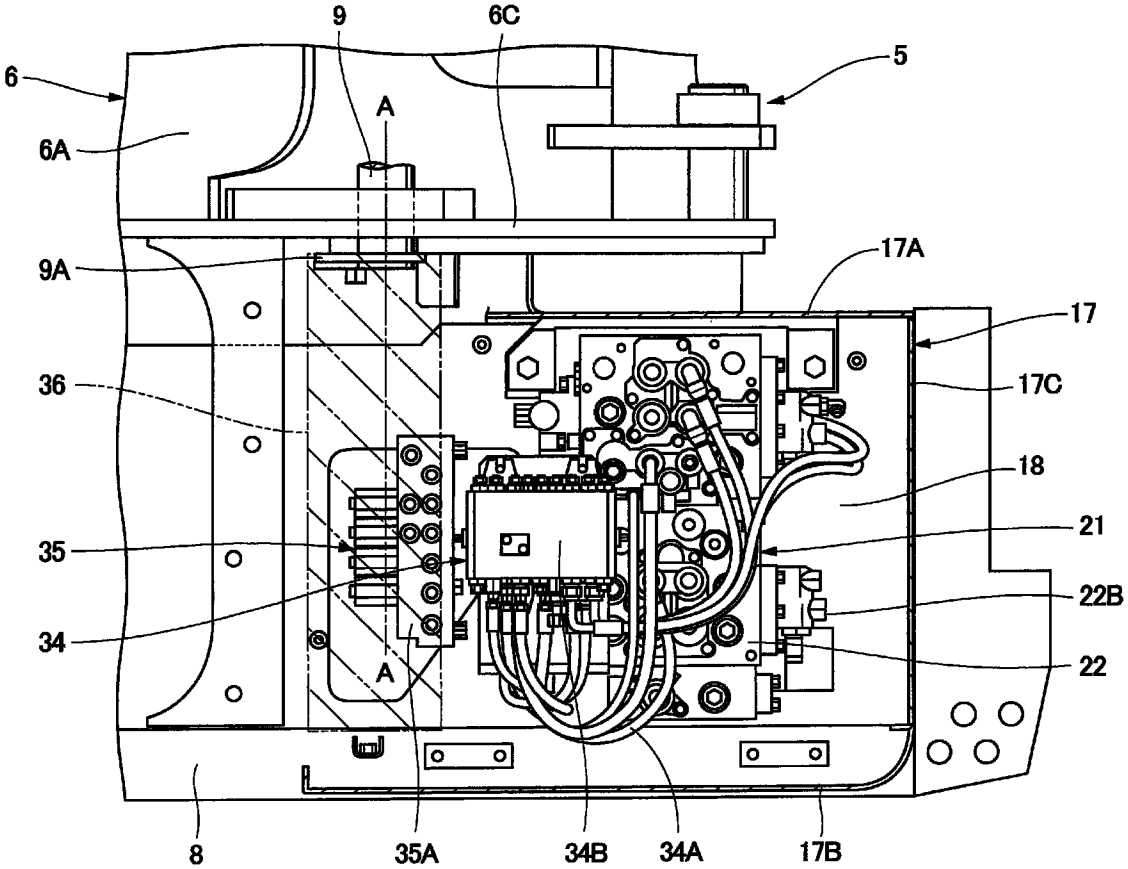
FIG. 4 is a cross section showing the right vertical plate, the boom foot pin, the right front housing cover, the first control valve unit, the signal control valve block, the solenoid valve and the like as viewed in the direction of arrows IV-IV in FIG. 3.
Figure 5:
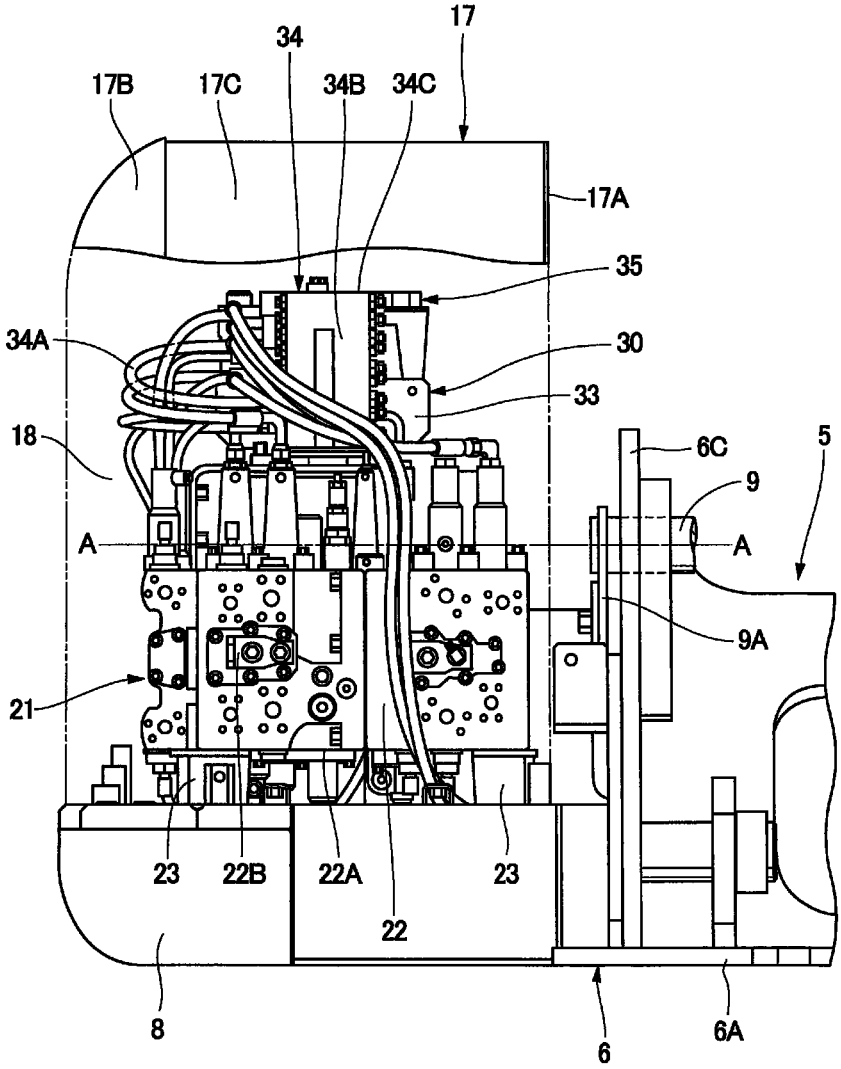
FIG. 5 is a front view showing the right vertical plate, the boom foot pin, the right front housing cover, the first control valve unit, the signal control valve block, the solenoid valve and the like as viewed in the direction of arrows V-V in FIG. 3.

The upper revolving structure 3 has a revolving frame 5 that serves as a vehicle body frame formed as a rigid support structure. As shown in FIG. 3 to FIG. 5, the revolving frame 5 is configured of a center frame 6 that is positioned in the central part in the left-right direction to extend in the front-rear direction, a left side frame 7 that is arranged in the left side of the center frame 6 to extend in the front-rear direction, and a right side frame 8 that is arranged in the right side of the center frame 6 to extend in the front-rear direction.

Here, the center frame 6 is provided with a flat bottom plate 6A that is formed using a thick steel plate or the like, and a left vertical plate 6B and a right vertical plate 6C that are provided to rise on the bottom plate 6A and oppose to each other by a predetermined interval in the left-right direction to extend in the front-rear direction. A boom foot portion 4A in the working mechanism 4 is arranged between the left and right vertical plates 6B and 6C. By inserting a boom foot pin 9 in the left and right vertical plates 6B and 6C and the boom foot portion 4A, the working mechanism 4 rotates (tilts up and down) in the upper-lower direction around the boom foot pin 9 to the revolving frame 5.

The boom foot pin 9 is inserted in/removed from the left and right vertical plates 6B and 6C along an axis line A-A extending in the left-right direction. A flat flange portion 9A is provided to be integral with an end portion (right end portion) of the boom foot pin 9 in the right vertical plate 6C side to project in a direction perpendicular to the axis line A-A. By fixing the flange portion 9A to the right vertical plate 6C, the removing stop and the rotating stop to the boom foot pin 9 can be performed.

A counterweight 10 is mounted on a rear end side in the revolving frame 5 to act as a weight balance to the working mechanism 4. Here, since the wheel type hydraulic excavator 1 travels on a public road, a revolving radius of the upper revolving structure 3 is desired to be as small as possible. Therefore, the counterweight 10 is arranged to be close to the revolving center of the upper revolving structure 3.

An engine 11 is positioned in the front side of the counterweight 10 and is mounted on a rear portion side on the revolving frame 5. The engine 11 is arranged in a transverse state where an axis line of a crank shaft (not shown) extends in the left-right direction. A cooling fan 11A is provided in the left side of the engine 11, and a cooling wind is supplied to a heat exchanger 12 formed of a radiator, an oil cooler and the like by this cooling fan 11A. First and second hydraulic pumps 37 and 39, which will be described later, driven by the engine 11 are provided in the right side of the engine 11.

Indicated at 13 is a cab that is arranged in the left side of the working mechanism 4, and the cab 13 is provided on a front portion left side (left side of the left vertical plate 6B) of the revolving frame 5, within which an operator's room is defined. Here, in the cab 13 are provided an operator's seat for an operator to be seated on, a steering wheel that performs a steering operation to the front wheels 2A of the lower traveling structure 2 (any thereof is not shown), an operation device 42, which will be described later, for perform a revolving operation of the upper revolving structure 3 and an operation of the working mechanism 4, and the like.

Indicated at 14 is a housing cover that is arranged in the front side of the counterweight 10. The housing cover 14 serves to cover on-board equipment, such as the engine 11, the heat exchanger 12, and the first and second hydraulic pumps 37 and 39, and the like. Here, the housing cover 14 is configured by an upper surface cover 14A that covers the on-board equipment from above, an engine cover 14B that is provided on the upper surface cover 14A to be capable of opening/closing, a left side door cover 14C that covers the on-board equipment from the left side to be capable of opening/closing, and a right side door cover 14D that covers the on-board equipment from the right side to be capable of opening/closing.

An operating oil tank 15 is mounted on the revolving frame 5 to be positioned in the right front side of the housing cover 14 (in the front side of the first and second hydraulic pumps 37 and 39). The operating oil tank 15 serves to reserve therein operating oil to be supplied to various kinds of hydraulic actuators mounted on the wheel type hydraulic excavator 1. A fuel tank 16 is mounted in the front side of the operating oil tank 15, that is, in the right front side of the revolving frame 5. The fuel tank 16 serves as to reserve therein fuel to be supplied to the engine 11.

Designated at 17 is a right front housing cover that is arranged in the right side of the working mechanism 4. The right front housing cover 17 is provided on the revolving frame 5 to be adjacent to the front side in the fuel tank 16. That is, the right front housing cover 17 is disposed at the opposite side to the cab 13 to interpose the vertical plates 6B and 6C in the revolving frame 5 therebetween. A valve accommodation room 18 is formed inside the right front housing cover 17 for accommodating a control valve unit 21, a signal control valve block 34, a solenoid valve 35 and the like, which will be described later, and the fuel tank 16 forms a rear surface of the valve accommodation room 18.

Here, the right front housing cover 17 includes a left side-plate 17A that is mounted on the revolving frame 5 and covers the valve accommodation room 18 from the left side, a right side plate 17B that is mounted on the revolving frame 5 in a state of facing the left side plate 17A and covers the valve accommodation room 18 from the right side to be capable of opening/closing, and a front surface plate 17C. That is, the front surface plate 17C is arranged between the left and right plates 17A and 17B, and extends in the oblique downward direction from an upper front end side in the fuel tank 16 to a position of a front end portion in the right side frame 8 to cover the valve accommodation room 18 from upward and forward. Accordingly, the valve accommodation room 18 is defined by a front surface 16A of the fuel tank 16 and the right front housing cover 17.

Here, the front surface plate 17C forming part of the right front housing cover 17 comprises an upper side horizontal surface portion 17C1 that extends horizontally from the front surface 16A of the fuel tank 16 to the forward side, and forms a substantially same plane as an upper surface 16B of the fuel tank 16, an upper side inclined surface portion 17C2 that is inclined in an oblique downward direction from a front end portion in the upper side horizontal surface portion 17C1 to the forward side, a lower side horizontal surface portion 17C3 that extends horizontally from a lower end portion in the upper side inclined surface portion 17C2 to the forward side, a lower side inclined surface portion 17C4 that is inclined in an oblique downward direction from a front end portion in the lower side horizontal surface portion 17C3 to the forward side, a bending portion 17C5 that is provided in a front end side in the lower side inclined surface portion 17C4, and a vertical surface portion 17C6 that extends in a vertical downward direction from the bending portion 17C5 to a position of a front end portion in the right side frame 8. In this case, the bending portion 17C5 of the front surface plate 17C is an intersection portion where the lower side inclined surface portion 17C4 and the vertical surface portion 17C6 intersect, and a section from the bending portion 17C5 to the lower end portion of the vertical surface portion 17C6 forms the front end portion of the right front housing cover 17.

In this way, the front surface plate 17C of the right front housing cover 17 is, as a whole, formed in a polygonal shape projecting from a rear end position (rear end of the upper side horizontal surface portion 17C1) to a front end position (lower end of the vertical surface portion 17C6). Particularly the front surface plate 17C is provided with the upper side inclined surface portion 17C2 and the lower side inclined surface portion 17C4 that are inclined in the oblique downward direction toward the forward side between the upper side horizontal surface portion 17C1 and the vertical surface portion 17C6 (intermediate section in the whole). The lower side inclined surface portion 17C4 is formed in a shape along a virtual line B-B to be described later, and is arranged in a position close to the virtual line B-B. That is, the lower side inclined surface portion 17C4 forms a surface that is formed in an oblique downward direction to be substantially in parallel with the virtual line B-B.

Three stages of flat steps 19 are provided to project in the forward direction on the front end portion of the right side frame 8 and the front surface plate 17C of the right front housing cover 17. Therefore, when a worker opens an engine cover 14B to perform an inspection work on the engine 11 and the like, the worker can easily get on the upper revolving structure 3 from the right front housing cover 17 by using the respective steps 19 as a foothold.

Next, an explanation will be made of the control valve unit 21, the signal control valve block 34, and the solenoid valve 35 that are arranged in the valve accommodation room 18 covered with the right front housing cover 17.

Designated at 21 is the control valve unit as a first control unit that is arranged in a front portion side in the valve accommodation room 18, and the control valve unit 21 comprises a valve casing 22 that is formed as a block body formed in a rectangular parallelepiped shape as a whole, and an assembly (not shown) of a plurality of directional control valves that are incorporated in the valve casing 22. The control valve unit 21 is mounted on a support base 23 that is provided on the revolving frame 5.

Figure 7:
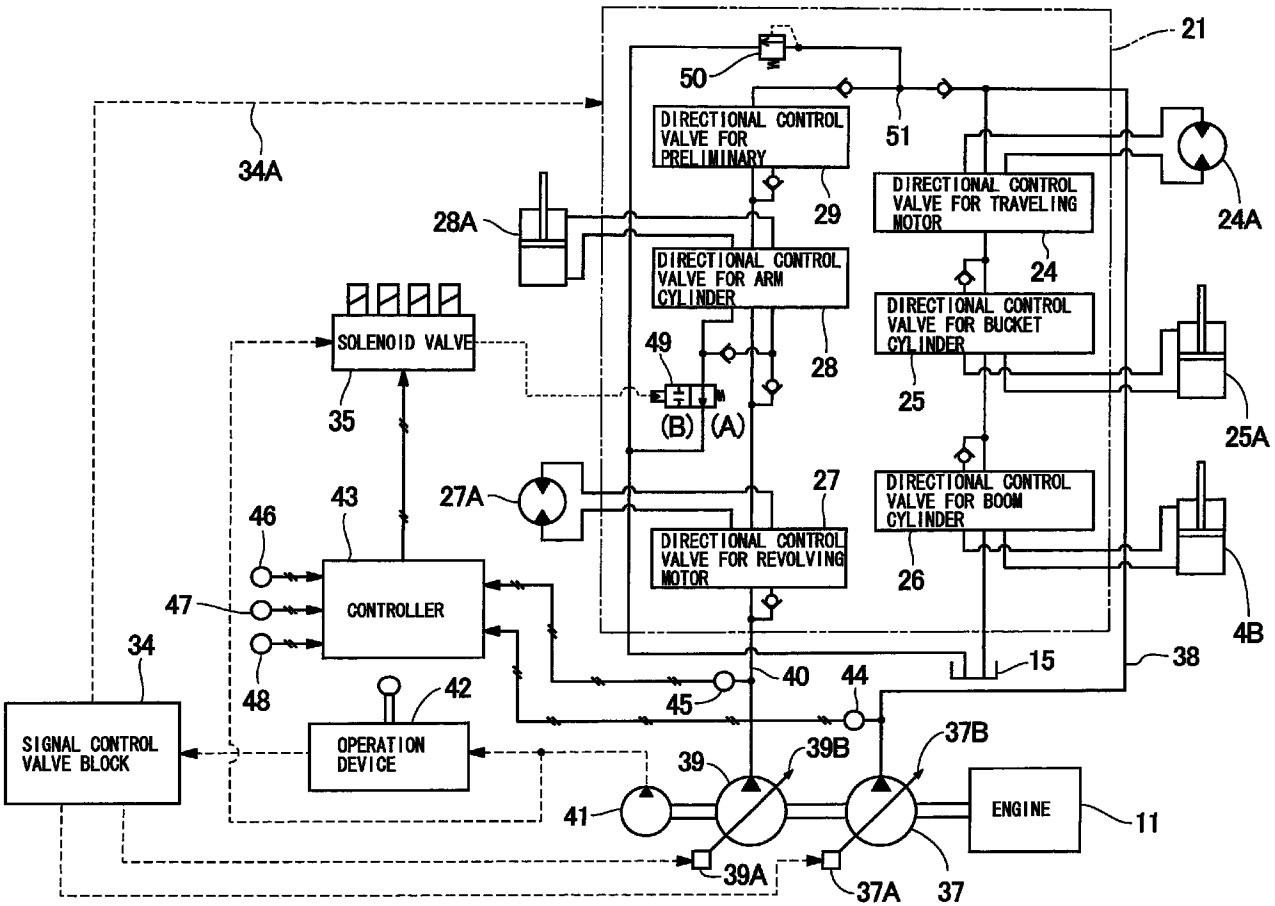

Here, as shown in FIG. 7, the directional control valves that are incorporated in the valve casing 22 comprise a directional control valve 24 for traveling motor, a directional control valve 25 for bucket cylinder, a directional control valve 26 for a boom cylinder 4B, a directional control valve 27 for revolving motor, a directional control valve 28 for arm cylinder, and a directional control valve for preliminary 29.

The directional control valve 24 for traveling motor controls a direction of pressurized oil to be supplied to a traveling motor 24A provided on the lower traveling structure 2, and the directional control valve 25 for bucket cylinder controls a direction of pressurized oil to be supplied to a bucket cylinder 25A of the working mechanism 4. The directional control valve 26 for boom cylinder 4B controls a direction of pressurized oil to be supplied to the boom cylinder 4B of the working mechanism 4, and a directional control valve 27 for revolving motor 27A controls a direction of pressurized oil to be supplied to the revolving motor 27A for revolving the upper revolving structure 3. The directional control valve 28 for arm cylinder controls a direction of pressurized oil to be supplied to an arm cylinder 28A of the working mechanism 4, and the directional control valve for preliminary 29 controls a direction of pressurized oil to be supplied to a preliminary hydraulic actuator (not shown).

The respective directional control valves 24 to 29 are configured of spool valves extending in the upper-lower direction, and each of the directional control valves 24 to 29 has a hydraulic pilot portion projecting in the upper-lower direction from the valve casing 22. When a pilot signal is supplied to each of the hydraulic pilot portions through a pilot line 34A from the signal control valve block 34 which will be described later, each of the directional control valves 24 to 29 is switched from a neutral position to an offset position. Thereby, the respective directional control valves 24 to 29 selectively supply pressurized oil from the first and second hydraulic pumps 37 and 39, which will be described later, to the traveling motor 24A, the bucket cylinder 25A, the boom cylinder 4B, the arm cylinder 28A, and the revolving motor 27A.

Here, among the respective directional control valves 24 to 29 forming the control valve unit 21, for example, assuming that the directional control valve 24 is arranged to the most right side frame 8 side, as shown in FIG. 3, a hydraulic pilot portion 24B of the directional control valve 24 projects downward from a lower surface 22A of the valve casing 22. A conduit connecting port 24C to which the pilot line 34A is connected is provided in a lower end portion of the hydraulic pilot portion 24B, and the conduit connecting port 24C is arranged upward of an upper surface 8A of the right side frame 8. Therefore, at the time of connecting the pilot line 34A to the conduit connecting port 24C, a tool of a spanner or the like can be inserted from the upper surface 8A of the right side frame 8 to the lower surface 22A side of the valve casing 22. Consequently, a connecting work between the conduit connecting port 24C and the pilot line 34A can be performed from an outside of the right side frame 8.

Figure 6:
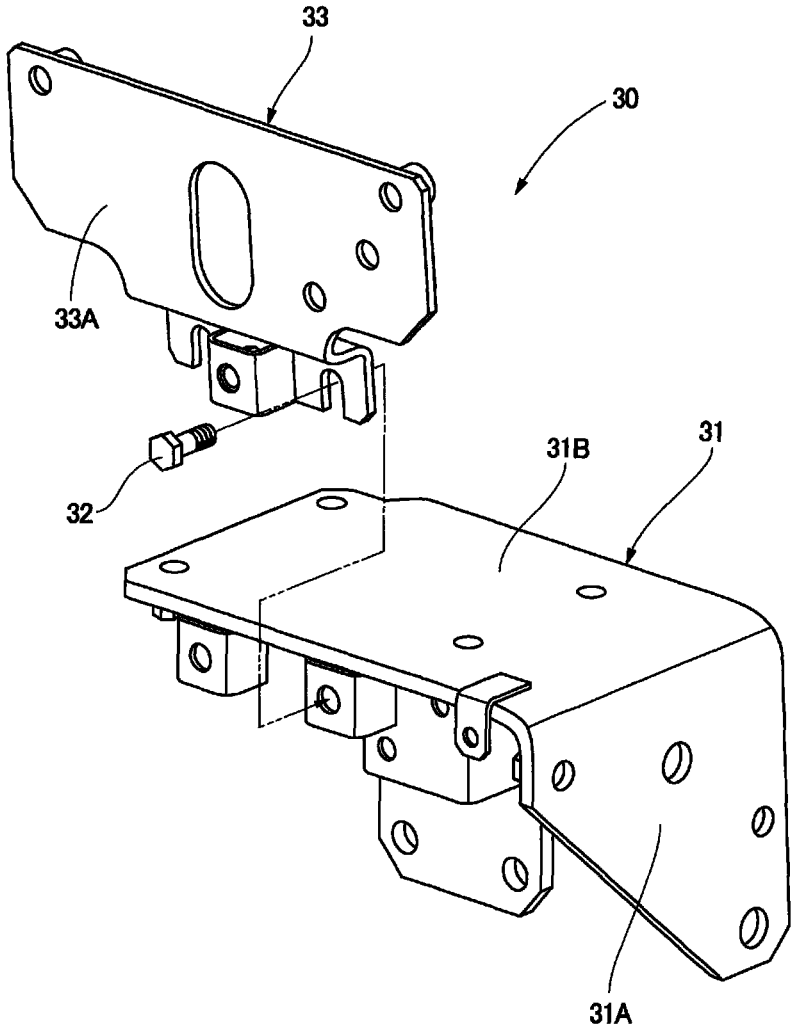
FIG. 6 is an exploded perspective view showing a bracket in FIG. 3.

Designated at 30 is the bracket that is mounted to the valve casing 22 of the control valve unit 21. The bracket 30 mounts the signal control valve block 34 and the solenoid valve 35, which will be described later, on the control valve unit 21. As shown in FIG. 6, the bracket 30 comprises a lower bracket 31 that is formed of a plate bent in a substantially L-letter shape and has a vertical surface portion 31A and a horizontal surface portion 31B, and a flat upper bracket 33 that is mounted on the lower bracket 31 using bolts 32 and rises upward from the horizontal surface portion 31B of the lower bracket 31.

The vertical surface portion 31A of the lower bracket 31 is mounted on a rear portion upper end side of the control valve unit 21 (valve casing 22) using bolts or the like, and the signal control valve block 34 to be described later is mounted on the horizontal surface portion 31B of the lower bracket 31. On the other hand, among the upper bracket 33, the solenoid valve 35 to be described later is mounted on a rear surface 33A thereof that is positioned in the fuel tank 16 side.

Next, designated at 34 is the signal control valve block as the second control valve, and the signal control valve block 34 is arranged in the back side of the control valve unit 21 and in the upper side of the control valve unit 21. The signal control valve block 34 comprises a block body 34B formed in a rectangular parallelepiped shape as a whole, and a plurality of signal control valves (not shown) that are incorporated in the block body 34B. The signal control valve block 34 is connected through the pilot line 34A to the hydraulic pilot portion of each of the directional control valves 24 to 29 forming the control valve unit 21, and outputs a pilot signal in response to an operation of the operation device 42 to be described later to each of the directional control valves 24 to 29. The signal control valve block 34 is, for example, as described in Japanese Patent Laid-Open No. 2000-248582 A shown as Patent Document 1, configured by combining many shuttle valves.

Here, as shown in FIG. 3, a front portion side in the signal control valve block 34 overlaps a rear portion side in the control valve unit 21 in the upper-lower direction, and a rear portion side in the signal control valve block 34 projects backward of the control valve unit 21. In this way, the signal control valve block 34 is arranged above the control valve unit 21 in a stepwise manner, and the virtual line B-B passing through an upper front end portion 34C of the signal control valve block 34 (block body 34B) and a front end portion 22B of the control valve unit 21 (valve casing 22) is inclined in an oblique downward direction toward the forward side from the signal control valve block 34.

Designated at 35 is the solenoid valve as the third control valve that is arranged in the back side of the signal control valve block 34. The solenoid valve 35 is formed of an assembly of a plurality of solenoid valves that are incorporated in a block body 35A formed in a rectangular parallelepiped shape. The block body 35A of the solenoid valve 35 is mounted on the upper bracket 33 of the bracket 30 using bolts or the like, and projects in the backward direction from the signal control valve block 34. Here, the solenoid valve 35 performs control of an arm regenerative valve 49, control of switching the traveling motor 24A to a high speed or a low speed, control of switching a cylinder (not shown) for suspending/supporting an axle of the front wheel 2A to a lock state or a non-lock state, which will be described later, and the like. That is, the solenoid valve 35 controls various kinds of hydraulic actuators of the arm cylinder 28A, the traveling motor 24A and the like, and hydraulic equipment including the first and second hydraulic pumps 37 and 39, which will be described later.

In this way, according to the present embodiment, the control valve unit 21 is arranged in the front portion side in the valve accommodation room 18, the signal control valve block 34 is arranged in the back side of the control valve unit 21 and in the upper side of the control valve unit 21, and further, the solenoid valve 35 is arranged in the back side of the signal control valve block 34.

Therefore, the control valve unit 21 and the signal control valve block 34 can be arranged to line up in the upper-lower direction, and as compared to a case where they are arranged to line up in the front-rear direction, the dimension of the right front housing cover 17 in the front-rear direction for covering the valve accommodation room 18 can be made small. Consequently, a position from the bending portion 17C5 of the front surface plate 17C forming the right front housing cover 17 to the lower end portion of the vertical surface portion 17C6, that is, the front end portion of the right front housing cover 17 can be moved (retracted) to the backward side.

In addition, the signal control valve block 34 is arranged above the control valve unit 21 in a stepwise manner, and thereby, as shown in FIG. 3, the virtual line B-B passing through the upper front end portion 34C of the signal control valve block 34 and the front end portion 22B of the control valve unit 21 is inclined in an oblique downward direction toward the forward side from the signal control valve block 34.

On the other hand, the front surface plate 17C of the right front housing cover 17 is formed in a polygonal shape projecting in the forward side as a whole by the upper side horizontal surface portion 17C1, the upper side inclined surface portion 17C2, the lower side horizontal surface portion 17C3, the lower side inclined surface portion 17C4, the bending portion 17C5, and the vertical surface portion 17C6. Therefore, the lower side inclined surface portion 17C4 arranged in the halfway section (intermediate section in the upper-lower direction) of the front surface plate 17C can be arranged to be positioned along and close to the virtual line B-B. Therefore, the position of the front end portion of the right front housing cover 17 (front surface plate 17C) configured by the bending portion 17C5 and the vertical surface portion 17C6 can be moved to the backward side (retracted).

Figure 1:
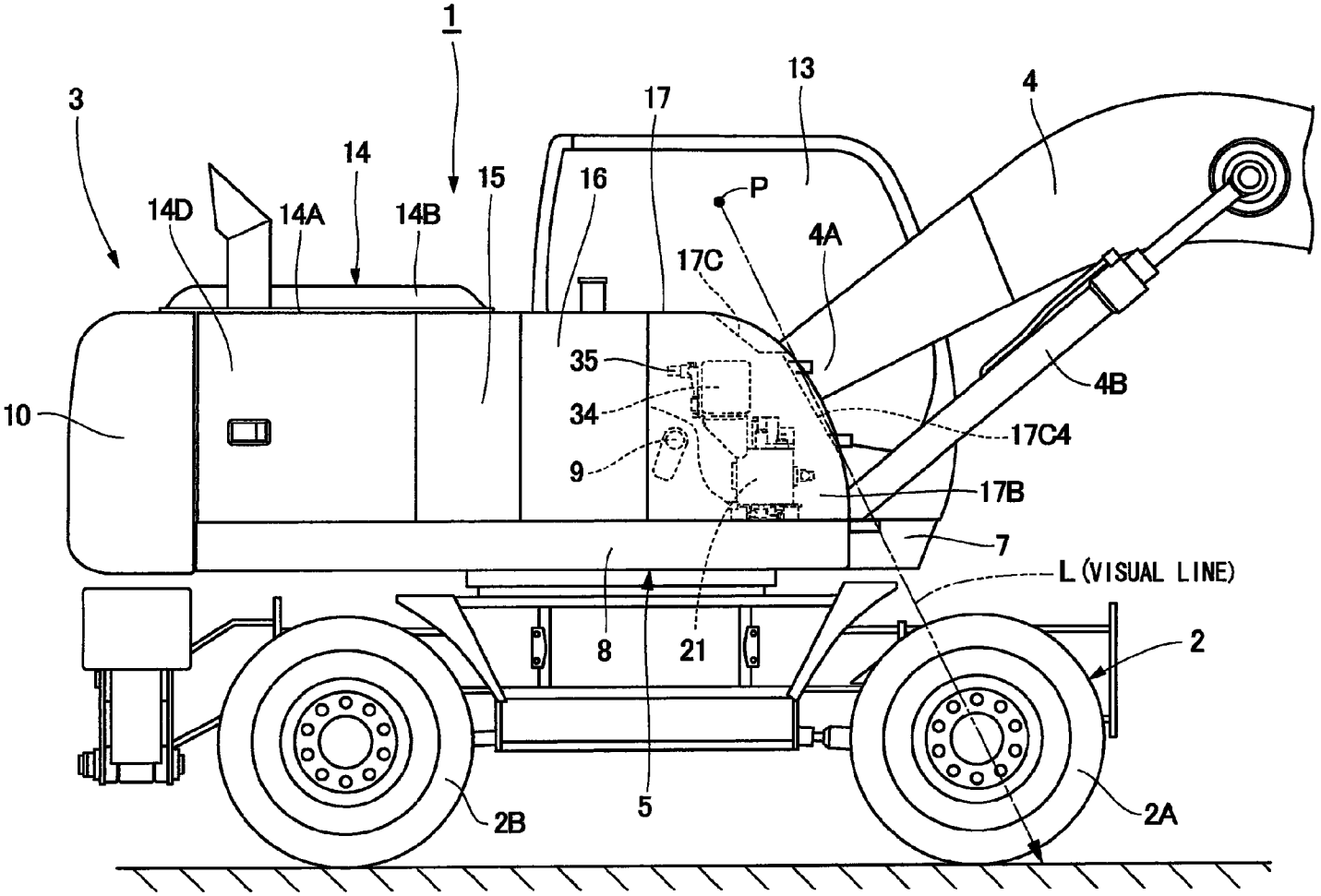
FIG. 1 is a side view showing a wheel type hydraulic excavator according to an embodiment in the present invention.
Figure 2:
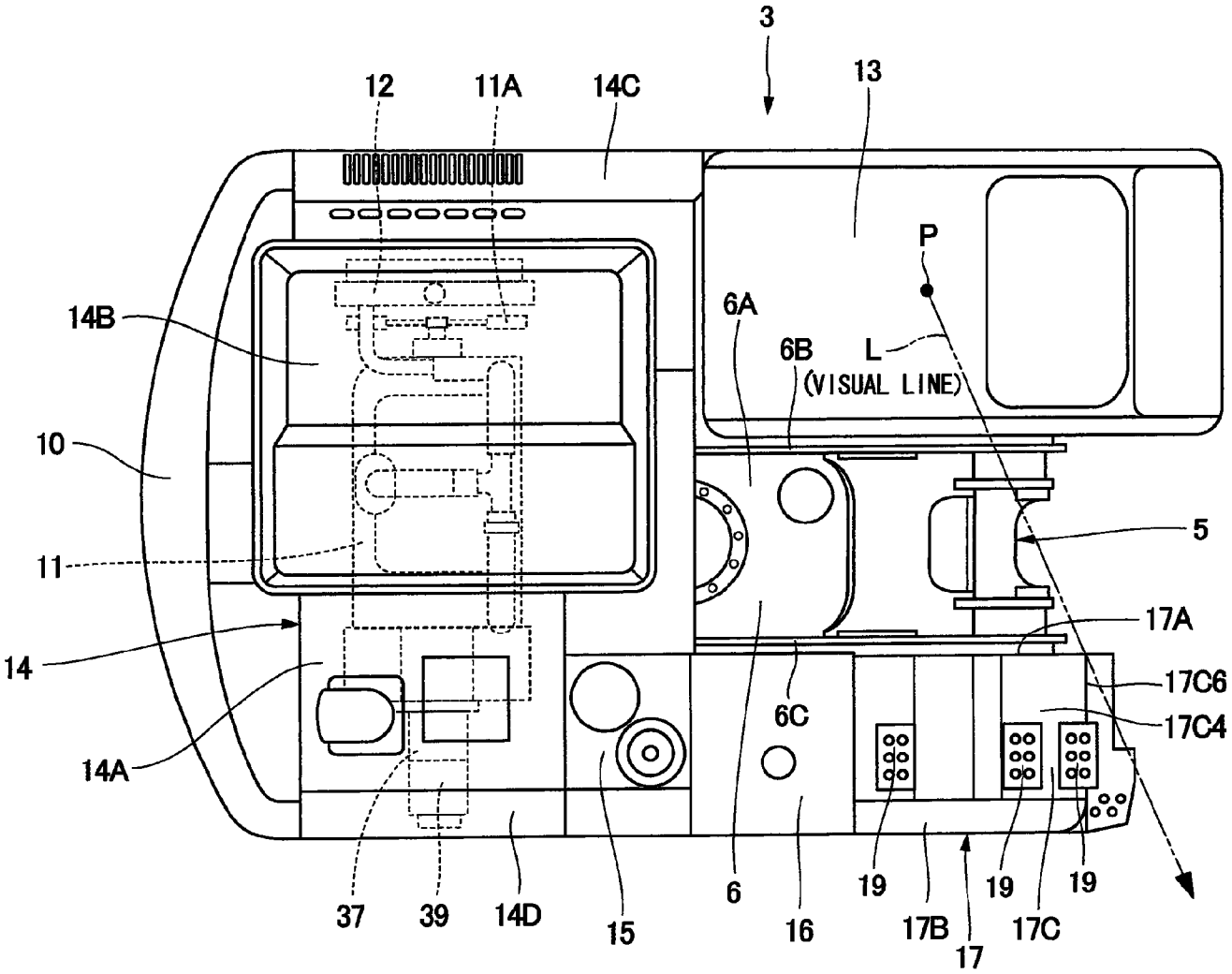
FIG. 2 is a plan view showing an upper revolving structure of the wheel type hydraulic excavator in a state where a working mechanism is removed therefrom.

Thereby, as shown in FIG. 1 and in FIG. 2, when an eye position of an operator in the cab 13 is indicated at an eye point P, a visual line L of the operator passing through the eye point P and the vertical surface portion 17C6 that is the front end portion of the right front housing cover 17 can be expanded in the backward side at the time the operator in the cab 13 visually looks in the right front side, to improve a range of view of the operator in the right front side.

Further, as shown in FIG. 4 and in FIG. 5, the control valve unit 21 and the signal control valve block 34 are arranged in the front side of an axis line A-A of the boom foot pin 9 that is inserted and fitted in the left and right vertical plates 6B and 6C of the revolving frame 5, and the solenoid valve 35 is arranged in the upper side of the axis line A-A of the boom foot pin 9.

Therefore, a pin inserting/removing space 36 shown to be hatched in a chain double-dashed line in FIG. 3 and in FIG. 4 is formed between the right side plate 17B of the right front housing cover 17 and the right vertical plate 6C of the center frame 6 forming the revolving frame 5. The pin inserting/removing space 36 is formed in the back side of the control valve unit 21 and the signal control valve block 34 and in the lower side of the solenoid valve 35. Therefore, the boom foot pin 9 can be inserted in/removed from the pin inserting/removing space 36.

Next, an explanation will made of a hydraulic system including the control valve unit 21, the signal control valve block 34 and the solenoid valve 35 with reference to FIG. 7.

Indicated at 37 is the first hydraulic pump of a variable displacement type that is driven by the engine 11. The first hydraulic pump 37 drives a displacement variable portion 37B by a regulator 37A to change a delivery displacement thereof. Here, the first hydraulic pump 37 is connected to the traveling motor 24A, the bucket cylinder 25A, and the boom cylinder 4B through a first main line 38. The directional control valve 24 for traveling motor 24A, the directional control valve 25 for bucket cylinder 25A, and the directional control valve 26 for boom cylinder 4B that form the control valve unit 21 are connected to the halfway of the first main line 38.

Indicated at 39 is the second hydraulic pump of a variable displacement type that is driven together with the first hydraulic pump 37 by the engine 11. The second hydraulic pump 39 drives a displacement variable portion 39B by a regulator 39A to change a delivery displacement thereof. Here, the second hydraulic pump 39 is connected to the arm cylinder 28A, the revolving motor 27A, and the preliminary actuator (not shown) through a second main line 40. The directional control valve 27 for revolving motor 27A, the directional control valve 28 for arm cylinder 28A, and the directional control valve 29 for preliminary actuator that form the first control valve unit 21 are connected to the halfway of the second main line 40.

Indicated at 41 is the pilot pump that is driven together with the first and second hydraulic pumps 37 and 39 by the engine 11. A pilot signal (pilot pressure) that is output from the pilot pump 41 is input to input ports of the signal control valve block 34 and the solenoid valve 35 in response to an operation of the operation device 42 that is arranged in the cab 13.

The signal control valve block 34, among the respective directional control valves 24 to 29 forming the control valve unit 21, outputs a pilot signal in response to an operation of the operation device 42 to the hydraulic pilot portion of the directional control valve corresponding to the actuator that is operated by the operation device 42. For example, in a case where an operator operates the traveling operation device 42, pressurized oil delivered from the first hydraulic pump 37 is supplied to the traveling motor through the directional control valve 24 for traveling motor to travel the lower traveling structure 2.

On the other hand, the signal control valve block 34 outputs a pilot signal in response to an operation of the operation device 42 to the regulators 37A and 39A of the first and second hydraulic pumps 37 and 39 for driving the displacement variable portion. For example, in a case where an operator operates the traveling operation device 42, a pilot signal for driving the displacement variable portion 37B is output to the regulators 37A of the first hydraulic pump 37 corresponding to the directional control valve 24 for traveling motor to change a delivery displacement of the first hydraulic pump 37.

Indicated at 43 is a controller, and to the controller 43 are input detection signals from a plurality of pressure sensors 44, 45, 46, 47, 48, and the like. The pressure sensor 44 outputs a detection signal corresponding to a delivery pressure of the first hydraulic pump 37, and the pressure sensor 45 outputs a detection signal corresponding to a delivery pressure of the second hydraulic pump 39. The pressure sensor 46 outputs a detection signal corresponding to a pilot pressure at the time of performing an operation of raising the boom, the pressure sensor 47 outputs a detection signal corresponding to a pilot pressure at the time of performing an operation of pulling in the arm, and the pressure sensor 48 outputs a detection signal corresponding to a pilot pressure at the time of performing an operation of revolving the upper revolving structure 3. The controller 43 determines an operating state of the hydraulic actuator that is operated by the operation device 42, based upon a detection signal input from each of the pressure sensors 44 to 48 or the like, and outputs a control signal corresponding to this operating state to the solenoid valve 35.

Indicated at 49 is the arm regenerative valve that is positioned between the directional control valve 28 for arm cylinder and the tank 15, and is provided in the halfway of the second main line 40. The arm regenerative valve 49, upon supply of a pilot pressure through the solenoid valve 35, is switched from a communication position (A) to a blockade position (B). When the arm regenerative valve 49 is held to the communication position (A), the pressurized oil that is discharged from one of a rod-side oil chamber and a bottom-side oil chamber in the arm cylinder 28A returns back to the tank 15. On the other hand, when the arm regenerative valve 49 is switched to the blockade position (B), the pressurized oil that is discharged from one of the rod-side oil chamber and the bottom-side oil chamber in the arm cylinder 28A can be supplied (regenerated) to the other oil chamber without returning back to the tank 15.

For example, in a case of performing a combined operation of the boom and the arm, the controller 43 determines an operating state of the arm cylinder 28A based upon detection signals from the pressure sensors 46 and 47. In a case where the controller 43 determines that the pressurized oil supplied to the arm cylinder 28A tends to be lacking, the controller 43 outputs a control signal to the solenoid valve 35, and a pilot pressure is supplied through the solenoid valve 35 to the arm regenerative valve 49. Therefore the arm regenerative valve 49 is switched from the communication position (A) to the blockade position (B), and the pressurized oil that is discharged from one of the rod-side oil chamber and the bottom-side oil chamber in the arm cylinder 28A can be supplied (regenerated) to the other oil chamber without returning back to the tank 15.

Here, the returned oil regeneration of the arm cylinder using the solenoid valve is described in Japanese Patent Laid-Open No. 2000-110803 A, for example. On the other hand, the solenoid valve 35, in place of a case of controlling the arm regenerative valve 49 for regenerating the pressurized oil discharged from the arm cylinder 28A, can be used in control of switching a high speed and a low speed of the traveling motor 24A, switching a lock and an unlock of a cylinder (not shown) that suspends and supports an axle of the right and left front wheels 2A, and the like.

It should be noted that in FIG. 7, designated at 50 is a main relief valve that returns a discharge pressure from each of the first and second hydraulic pumps 37 and 39 back to the tank 15, and the main relief valve 50 is provided between a joining point 51 of the first and second main lines 38 and 40 at the most downstream side and the tank 15.

The wheel type hydraulic excavator 1 according to the present embodiment has the configuration as described above, and the wheel type hydraulic excavator 1 travels on a public road toward a working site by driving the front wheels 2A and the rear wheels 2B provided in the lower traveling structure 2. The wheel type hydraulic excavator 1 revolves the upper revolving structure 3 at a working site and performs an excavating operation of earth and sand and the like using the working mechanism 4.

Here, the wheel type hydraulic excavator 1 according to the present embodiment arranges the control valve unit 21 in the front portion side in the valve accommodation room 18 covered with the right front housing cover 17. The signal control valve block 34 is arranged in the back side of the control valve unit 21 and in the upper side of the control valve unit 21. Further, the solenoid valve 35 is arranged in the back side of the signal control valve block 34.

Therefore, the control valve unit 21 and the signal control valve block 34 can be arranged to line up in the upper-lower direction. Accordingly, as compared to a case where the control valve unit 21 and the signal control valve block 34 are arranged to line up in the front-rear direction, the dimension of the right front housing cover 17 in the front-rear direction that covers the valve accommodation room 18 can be made small to move (retract) the position of the front surface plate 17C forming part of the right front housing cover 17 to the backward side.

In addition, the signal control valve block 34 is arranged above the control valve unit 21 in a stepwise manner, and thereby, as shown in FIG. 3, the virtual line B-B passing through the upper front end portion 34C of the signal control valve block 34 and the front end portion 22B of the control valve unit 21 can be inclined in an oblique downward direction toward the forward side from the signal control valve block 34. Therefore, the front surface plate 17C forming part of the right front housing cover 17 is formed in a polygonal shape projecting in the forward side as a whole, and the lower side inclined surface portion 17C4 arranged in the halfway section (intermediate section in the upper-lower direction) of the front surface plate 17C can be arranged to be positioned along the virtual line B-B and to be close to the virtual line B-B. Thus, the position of the front end portion of the right front housing cover 17 configured by the bending portion 17C5 and the vertical surface portion 17C6 of the front surface plate 17C can be moved to the backward side (retracted).

As a result, as shown in FIG. 1 and in FIG. 2, when an eye position of an operator in the cab 13 is indicated at the eye point P, in a case where the operator in the cab 13 virtually looks in the right forward side, a visual line L of the operator passing through the eye point P and the vertical surface portion 17C6 that is the front end portion of the right front housing cover 17 can be expanded in the backward side. Therefore, in a case where the wheel type hydraulic excavator 1 travels on a public road, the range of view of the operator in the right forward side can be improved to enhance the safety at the time the wheel type hydraulic excavator 1 travels.

In the wheel type hydraulic excavator 1 according to the present embodiment, the control valve unit 21 and the signal control valve block 34 are arranged in the front side of the axis line A-A of the boom foot pin 9 that is inserted/fitted in the left and right vertical plates 6B and 6C of the revolving frame 5. Further, the solenoid valve 35 is arranged in the upper side of the axis line A-A of the boom foot pin 9.

Incidentally, the boom foot pin 9 is inserted/removed between the right side plate 17B of the right front housing cover 17 and the right vertical plate 6C of the center frame 6 forming the revolving frame 5. That is, in the present embodiment, the pin inserting/removing space 36 shown to be hatched in a chain double-dashed line in FIG. 3 and in FIG. 4 can be formed to be positioned in the back side of the control valve unit 21 and the signal control valve block 34 and in the lower side of the solenoid valve 35.

As a result, in a state where the signal control valve block 34 is mounted on the rear portion upper side of the control valve unit 21 and the solenoid valve 35 is mounted on the back side of the signal control valve block 34, the boom foot pin 9 can be easily inserted in/removed from the left and right vertical plates 6B and 6C of the center frame 6 and the boom foot portion 4A of the working mechanism 4 in the large pin inserting/removing space 36, thus enhancing the workability.

Further, according to the present embodiment, the bracket 30 is provided to the control valve unit 21, and the signal control valve block 34 and the solenoid valve 35 are mounted to the bracket 30. As a result, the signal control valve block 34 and the solenoid valve 35 can simultaneously be mounted to or removed from the control valve unit 21 by using the bracket 30, and the workability at the time of mounting the signal control valve block 34 and the solenoid valve 35 to the control valve unit 21 can be enhanced.

It should be noted that in the above-mentioned embodiment, there is exemplified a case where the signal control valve block 34 is arranged in the back side and in the upper side of the control valve unit 21, and the solenoid valve 35 is arranged in the back side of the signal control valve block 34. However, the present invention is not limited thereto, and may be configured, for example, such that the solenoid valve 35 is arranged in the back side and in the upper side of the control valve unit 21, and the signal control valve block 34 is arranged in the back side of the solenoid valve 35.

Further, the above-mentioned embodiment is explained by taking the wheel type hydraulic excavator 1 equipped with the front wheel 2A and the rear wheel 2B as an example of the construction machine. However, the present invention is not limited thereto, and may be widely applied also to other construction machines, such as a hydraulic excavator equipped with a crawl type lower traveling structure.

DESCRIPTION OF REFERENCE NUMERALS

1: Wheel type hydraulic excavator (Construction machine)
2: Lower traveling structure (Vehicle body)
3: Upper revolving structure (Vehicle body)
4: Working mechanism
4A: Boom foot portion
5: Revolving frame (Vehicle body frame)
6: Center frame
6A: Bottom plate
6B: Left vertical plate
6C: Right vertical plate
7: Left side frame
8: Right side frame
9: Boom foot pin
13: Cab
16: Fuel tank
17: Right front housing cover
17A: Left side plate
17B: Right side plate
17C: Front surface plate
17C4: Lower side inclined surface portion
18: Valve accommodation room
19: Step
21: Control valve unit (First control valve)
22B: Front end portion
24, 25, 26, 27, 28, 29: Directional control valve
30: Bracket
34: Signal control valve block (Second control valve)
34C: Upper front end portion
35: Solenoid valve (Third control valve)
36: Pin inserting/removing space
37, 39: Hydraulic pump
42: Operation device
A-A: Axis line
B-B: Virtual line

The invention claimed is:

1. A construction machine comprising:

an automotive vehicle body (2, 3);

a working mechanism (4) that is tiltably provided in a front portion side of said vehicle body (3);

a cab (13) that is positioned in the left side of said working mechanism (4) and is provided in a front portion side in said vehicle body (3) to define an operator's room;

a right front housing cover (17) that is positioned in the right side of said working mechanism (4) and is provided in a front portion side in said vehicle body (3) and within which a valve accommodation room (18) is formed;

a hydraulic pump (37, 39) that is mounted on said vehicle body (3) to deliver pressurized oil toward a plurality of hydraulic actuators; and an operation device (42) that is provided in said cab (13) to be operated by an operator for driving said respective hydraulic actuators, wherein a first control valve (21) that is configured of a collector of a plurality of directional control valves (24, 25, 26, 27, 28, 29) to control a flowing direction of the pressurized oil to be supplied to said respective hydraulic actuators from said hydraulic pump (37, 39), a second control valve (34) that outputs an operation signal output to said directional control valves (24, 25, 26, 27, 28, 29) of said first control valve (21) from said operation device (42), and a third control valve (35) that controls hydraulic equipment including said hydraulic actuator and said hydraulic pump (37, 39), are provided in said right front housing cover (17), characterized in that:

said first control valve (21) is arranged in a front portion side in said valve accommodation room (18), said second control valve (34) is arranged in the back side of said first control valve (21) and in the upper side of said first control valve (21), said third control valve (35) is arranged in the back side of said second control valve (34), and said right front housing cover (17) is provided along a virtual line (B-B) extending in an oblique downward direction through a front end (22B) of said first control valve (21) and a front end (34C) of said second control valve (34).

2. The construction machine according to claim 1, wherein said right front housing cover (17) comprises:

a left side plate (17A) and a right side plate (17B) that cover said valve accommodation room (18) from the left side and right side; and a front surface plate (17C) that covers said valve accommodation room (18) from upward and forward, wherein said front surface plate (17C) is formed in a polygonal shape projecting as a whole, and is provided with a lower side inclined surface portion (17C4) at a halfway section to be inclined in an oblique downward direction toward the forward side, and said lower side inclined surface portion (17C4) is configured to be substantially in parallel with said virtual line (B-B).

3. The construction machine according to claim 1, wherein said second control valve (34) is arranged in a stepwise manner in the upper side of said first control valve (21) in a state of overlapping a rear portion side in said first control valve (21) in the upper-lower direction.

4. The construction machine according to claim 1, wherein a vehicle body frame (5) that is a base of said vehicle body (3) comprises:

a center frame (6) including a bottom plate (6A), and left and right vertical plates (6B, 6C) that are provided to rise on said bottom plate (6A) and extend in the front-rear direction; and a left side frame (7) and a right side frame (8) that are arranged in the left side and right side of said center frame (6), a boom foot portion (4A) of said working mechanism (4) is rotatably mounted to said left and right vertical plates (6B, 6C) of said center frame (6) through a boom foot pin (9), and said first control valve (21) and said second control valve (34) are arranged in the front side of an axis line (A-A) of said boom foot pin (9).

5. The construction machine according to claim 4, wherein a pin inserting/removing space (36) is provided between a right side plate (17B) of said right front housing cover (17) and said right vertical plate (6C) of said center frame (6) to be positioned in the lower side of said third control valve (35) for inserting/removing said boom foot pin (9) in/from said left and right vertical plates (6B, 6C).

6. The construction machine according to claim 1, wherein a bracket (30) is provided in said first control valve (21) to project from the rear portion side to the upward side, wherein said second control valve (34) and said third control valve (35) are removably mounted on said bracket (30).

7. The construction machine according to claim 1, wherein a fuel tank (16) is positioned in the back side of said right front housing cover (17) at the right side of said vehicle body (3) to form a rear surface of said valve accommodation room (18), and said right front housing cover (17) is provided with a step (19) which is a foothold for getting on said vehicle body (3).

* * * * *